US008015628B2

(12) United States Patent
Campau et al.

(10) Patent No.: US 8,015,628 B2
(45) Date of Patent: Sep. 13, 2011

(54) ON-TANK TOILET DISPENSER

(75) Inventors: Daniel N. Campau, Ada, MI (US); Michael C. Fryan, Racine, WI (US); Steven A. Zach, Racine, WI (US); Douglas A. Soller, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 315 days.

(21) Appl. No.: 12/354,129

(22) Filed: Jan. 15, 2009

(65) Prior Publication Data

US 2009/0178188 A1 Jul. 16, 2009

Related U.S. Application Data

(60) Provisional application No. 61/021,099, filed on Jan. 15, 2008.

(51) Int. Cl.
*E03D 9/00* (2006.01)

(52) U.S. Cl. ..... 4/225.1; 4/227.1; 4/227.4; 4/227.7; 222/400.7; 222/400.8

(58) Field of Classification Search ..... 4/225.1, 4/227.1, 227.7; 222/400.7, 400.8, 464.7
See application file for complete search history.

(56) References Cited

U.S. PATENT DOCUMENTS

| | | | | | |
|---|---|---|---|---|---|
| 3,254,797 | A | * | 6/1966 | Porter | 222/57 |
| 3,890,657 | A | | 6/1975 | Gray | |
| 3,913,151 | A | * | 10/1975 | Keimig | 4/224 |
| 3,953,902 | A | * | 5/1976 | Taylor | 4/227.5 |
| 3,999,226 | A | * | 12/1976 | Wolf | 4/225.1 |
| 4,064,572 | A | | 12/1977 | Wicks | |
| 4,491,988 | A | * | 1/1985 | Mizuno | 4/227.4 |
| 4,571,752 | A | | 2/1986 | Bick | |
| 4,696,414 | A | | 9/1987 | Huat | |
| 5,042,095 | A | * | 8/1991 | Schoepe et al. | 4/225.1 |
| 5,152,015 | A | * | 10/1992 | Fourman | 4/225.1 |
| 5,353,957 | A | | 10/1994 | Campau | |
| 5,903,930 | A | | 5/1999 | Huang | |
| 6,321,392 | B1 | | 11/2001 | Sim | |
| 6,748,610 | B2 | | 6/2004 | Zach et al. | |
| 2008/0260551 | A1 | | 10/2008 | Simmons | |

FOREIGN PATENT DOCUMENTS

DE 2620003 B1 9/1977

OTHER PUBLICATIONS

PCT/US2009/000248 International Search Report and Written Opinion dated May 15, 2009.

* cited by examiner

*Primary Examiner* — Gregory L. Hudson
*Assistant Examiner* — Lauren Heitzer

(57) ABSTRACT

Disclosed is a dispenser for dispensing a composition in response to level changes in a liquid in a tank. The dispenser includes a container for holding the composition, a discharge conduit in fluid communication with the container, an air inlet in fluid communication with the container, and a level sensing member mounted to the dispenser such that a lower end of the level sensing member contacts the liquid in the tank and senses its level. In use, a rise of the liquid in the tank between a lower liquid level and a higher liquid level causes the level sensing member to alter air pressure in a headspace of the container above the composition and thereby cause a controlled discharge of the composition from the discharge conduit; and a fall of the liquid in the tank between the higher liquid level and the lower liquid level causes the level sensing member to alter pressure in the headspace and thereby causing air to be vented into the headspace from the air inlet.

20 Claims, 12 Drawing Sheets

ON-TANK TOILET DISPENSER

CROSS-REFERENCES TO RELATED APPLICATIONS

This application claims priority based on U.S. provisional application 61/021,099, filed Jan. 15, 2008.

STATEMENT REGARDING FEDERALLY SPONSORED RESEARCH

Not Applicable.

BACKGROUND OF THE INVENTION

The present invention relates to automatic dispensers used in liquid holding tanks in which the liquid level changes, and in particular to such dispensers which dispense cleaner from a container into a toilet overflow tube.

A variety of dispensers exist for automatically dispensing chemicals into a water tank such as a toilet tank. Some toilet bowl cleaner dispensers use a float valve which opens and closes with changes in the toilet tank level during a flush cycle. For example, U.S. Pat. No. 5,903,930 describes a toilet cleansing agent dispenser having a cylindrical housing, a receiving body, and a float piece. The cylindrical housing is provided with a frame for mounting the dispenser in a toilet water tank. The float piece is capable of up-and-down displacement in accordance with the water level in the toilet water tank, so as to regulate the flow of the toilet cleansing agent from the receiving body into the toilet water tank.

As the water level in the toilet water tank rises to a certain level after the flush, the float piece seals off the flow hole of the receiving body so as to terminate the flow of the cleansing agent into the toilet water tank. This type of dispenser can be inefficient. First, many such automatic liquid dispensers have a tendency for the product that is being dispensed to leak out of the dispenser in a somewhat uncontrolled manner which can result in overdosing of the product. Second, the objective is to keep the toilet bowl clean, not the water holding tank. Since all the cleaner is dispensed into the tank, rather than the bowl, most of the cleaner is flushed down the drain without cleaning the toilet bowl at all.

It has been recognized that cleaner can be dispensed into the toilet overflow tube rather than into the toilet tank. For example, U.S. Pat. No. 3,254,797 describes a liquid chemical dispenser that is attached to the overflow pipe with a float positioned beneath the water in the toilet tank. Upon flushing, the water moves downward allowing the float to move downward to flex a diaphragm downwardly. This opens an inlet valve which allows liquid to fill the diaphragm cavity above the diaphragm. As the toilet tank refills with water, the float moves upward to flex the diaphragm upwardly to discharge liquid from the cavity above the diaphragm and into the overflow pipe.

U.S. Pat. No. 6,321,392 describes another example device that dispenses cleaner into the toilet overflow tube. The device uses a solid puck of a chlorine donor. A body member receives the solid puck of cleaning agent. An inlet is in communication with the body member and is connectable to a ball cock through a refill tube, and an outlet is in communication with the body member and is connectable to the toilet overflow pipe through a connecting hose. The device delivers water and dissolved cleaner to the toilet overflow tube as the tank fills after a flush. However, the use of a solid puck results in inconsistent release of actives to the toilet bowl, particularly when the puck is near the end of its life.

U.S. Pat. No. 5,353,957 describes yet another example device that dispenses cleaner into the toilet overflow tube. The device includes a container for holding a liquid cleaner, a dispensing nozzle, and a sensing tube. The dispensing nozzle is positioned on the container below the liquid level within the container. The sensing tube is immersible in the water in the toilet tank, whereby the cyclic fall and rise of the tank water results in the discharge of the liquid from the container through the dispensing nozzle. The container can be clipped to the upper open end of the toilet overflow tube such that the liquid falls from the dispensing nozzle into the toilet overflow tube.

U.S. Pat. No. 5,152,015 describes still another example device that dispenses cleaner into the toilet overflow tube. The dispensing device includes an accumulator chamber having a conduit communicating with the toilet tank water. The accumulator chamber also has a product inductor conduit communicating with a product chamber. The device also includes a first product discharge conduit communicating with the accumulator chamber and a second product discharge conduit communicating with the discharge conduit and extending into the toilet tank overflow pipe. When the toilet tank water level falls during flushing, the water level in the conduit falls, causing a reduced pressure in the accumulator chamber and a rising of the product in the inductor conduit. When the toilet tank fills, the water rises in the toilet tank, compressing the air in the conduit forcing the product to be discharged from the accumulator through the first and the second product discharge conduit and into the toilet tank overflow pipe.

Notwithstanding this variety of devices which dispense cleaner into a toilet overflow tube, a need still exists for improved dispensers for delivering an accurately controlled volume of liquid cleaner into a toilet overflow tube at a time when it will remain in the toilet bowl until the next flush.

SUMMARY OF THE INVENTION

In a general aspect, the invention provides a dispenser that hangs on the outer wall of a toilet tank and utilizes the rise and fall of the toilet tank water during a flush to deliver a flowable composition from a container into the toilet overflow tube. The composition is then delivered into the toilet bowl from the toilet overflow tube after the flapper valve in the toilet tank closes which allows all of the cleaner to stay in the toilet bowl and work until the next flush. A user can hang the dispenser on the outer wall of a toilet tank and attach the composition container with little fuss. The working mechanism of the dispenser is a pumping system that does not require any moving parts but uses the rise and fall of the toilet tank water during a flush. Using the rise and fall of the tank water to pump a liquid composition from a container to the overflow tube allows a greater concentration of chemicals in the toilet bowl that stay there in between flushes to keep the toilet bowl cleaner for a longer period of time.

In one aspect, the invention provides a dispenser for dispensing a composition in response to level changes in a liquid in a tank. The dispenser has a container for holding the composition, a discharge conduit in fluid communication with the container, an air inlet in fluid communication with the container, and a level sensing member mounted to the dispenser such that a lower end of the level sensing member contacts the liquid in the tank and senses its level.

A rise of the liquid in the tank between a lower liquid level and a higher liquid level can cause the level sensing member to displace a volume of air from one section of the dispenser, thereby causing a concurrent displacement of product from another section of the dispenser while maintaining a constant (e.g., atmospheric) pressure throughout the dispenser during the entire cycle.

In certain embodiments, the dispenser further comprises a holder structured to mount the container on a top end of an outer wall of the tank, the holder has at least one hook for mounting the container on a top end of an outer wall of the tank, there is a vent tube having an upper end opening and a lower end opening, the upper end opening of the vent tube being in fluid communication with the air inlet, and the lower end opening of the vent tube being in fluid communication with a section of an interior space of the container. In one particular non-limiting embodiment, the vent tube includes a check valve in the lower end opening.

There can also be a compartment in fluid communication with the container and in fluid communication with the discharge conduit, the compartment accumulating an amount of the composition before a portion of the amount of the composition is discharged from the discharge conduit. The compartment can be in fluid communication with the container by way of a composition supply conduit having a lower orifice, the compartment includes an exit passageway having an upper inlet and a lower outlet, and the lower orifice of the composition supply conduit is positioned in the compartment below the upper inlet of the lower exit passageway of the compartment when a holder mounts a fluid control tube. The upper inlet of the lower exit passageway can be located on a top surface of an interior shoulder of the compartment, such that the lower orifice of the composition supply conduit is positioned in a well below the top surface of the interior shoulder of the compartment.

In other forms, there can be an air gap hole located in a discharge passageway between the container and a discharge opening of the discharge conduit, a vent tube having an upper end opening and a lower end opening, the upper end opening of the vent tube being in fluid communication with the air inlet, and the lower end opening of the vent tube being in fluid communication with a lower section of an interior space of the container, and a supply tube having an upper end opening and a lower end opening, the upper end opening of the supply tube being in fluid communication with the discharge conduit, and the lower end opening of the supply tube being in fluid communication with the lower section of the interior space of the container.

In this regard the lower end opening of the supply tube can be located above the lower end opening of the vent tube, and there can be a closure for sealing a mouth of the container as well as a vent tube attached to the closure. The vent tube has an upper end opening and a lower end opening, the upper end opening of the vent tube being in fluid communication with the air inlet, and the lower end opening of the vent tube being in fluid communication with a lower section of an interior space of the container, and there is a supply tube attached to the closure, the supply tube having an upper end opening and a lower end opening, the upper end opening of the supply tube being in fluid communication with the discharge conduit, and the lower end opening of the supply tube being in fluid communication with the lower section of the interior space of the container. A latch can be provided for holding the closure against the mouth of the container.

In another aspect of the invention the dispenser further comprises a housing and a diaphragm wherein the housing has an open end that is sealed by the diaphragm thereby defining an interior space of the housing. The interior space is in fluid communication with the headspace of the container above the composition. The level sensing member can be a float, and the float can be attached to the diaphragm. As liquid falls in the tank from a higher liquid level to a lower liquid level, the diaphragm may flex in a first direction and displace air in the headspace to be vented into the headspace from the air inlet. The rise of liquid in the tank between the lower liquid level and the higher liquid level causes the diaphragm to flex in a second direction to alter air pressure in the headspace of the container above the composition and thereby cause the controlled discharge of the composition from the discharge conduit. In some embodiments, there is a constant pressure within the dispenser during the entire cycle. In one embodiment, the pressure is atmospheric.

The float can be attached to a rod that is attached to the diaphragm, and the longitudinal position of the float on the rod can be adjustable so that the height of the float in the tank can be adjusted.

Also, the parts can be configured and selected such that the air inlet passes through the closure, the tank is a toilet tank, and the liquid is water.

In another aspect the invention provides a method for delivering a composition to a toilet bowl of a toilet having a toilet tank using a device of the above kind. One mounts the level sensor such that a lower end of the level sensor contacts water in the toilet tank, positions the discharge conduit such that a discharge opening of the discharge conduit can deliver the composition to the toilet bowl, and flushes the toilet.

A fall of liquid in the tank between a higher liquid level and a lower liquid level (as the flush cycle starts) causes the level sensing member to alter air pressure in a headspace of the container above the composition and thereby causes air to be vented into the headspace from the air inlet. A subsequent rise of the liquid in the tank between a lower liquid level and a higher liquid level (as the flush cycle is ending) causes the level sensing member to alter pressure in the headspace and thereby causes a controlled discharge of the composition from the discharge conduit.

In preferred forms of the method, the discharge opening of the discharge conduit is positioned in or above an overflow tube of the toilet or adjacent a rim of the toilet bowl of the toilet. Also, the container can be mounted on a top end of an outer wall of the toilet tank or on a top end of an outer wall of the toilet tank such that the container is located outside the toilet tank.

In one aspect the liquid level sensor is in the form of a tube having a lower end immersed in the tank water such that water rises or falls in the tube during the flushing cycle.

The foregoing and other advantages of the present invention will become apparent from the following description. In that description reference will be made to the accompanying drawings which form a part thereof, and in which there is shown by way of illustration an example embodiment of the invention. The example embodiment does not limit the full scope of the invention.

BRIEF DESCRIPTION OF THE DRAWINGS

Like reference numerals will be used to refer to like parts from Figure to Figure in the following detailed description.

DETAILED DESCRIPTION OF THE INVENTION

Figure 1:
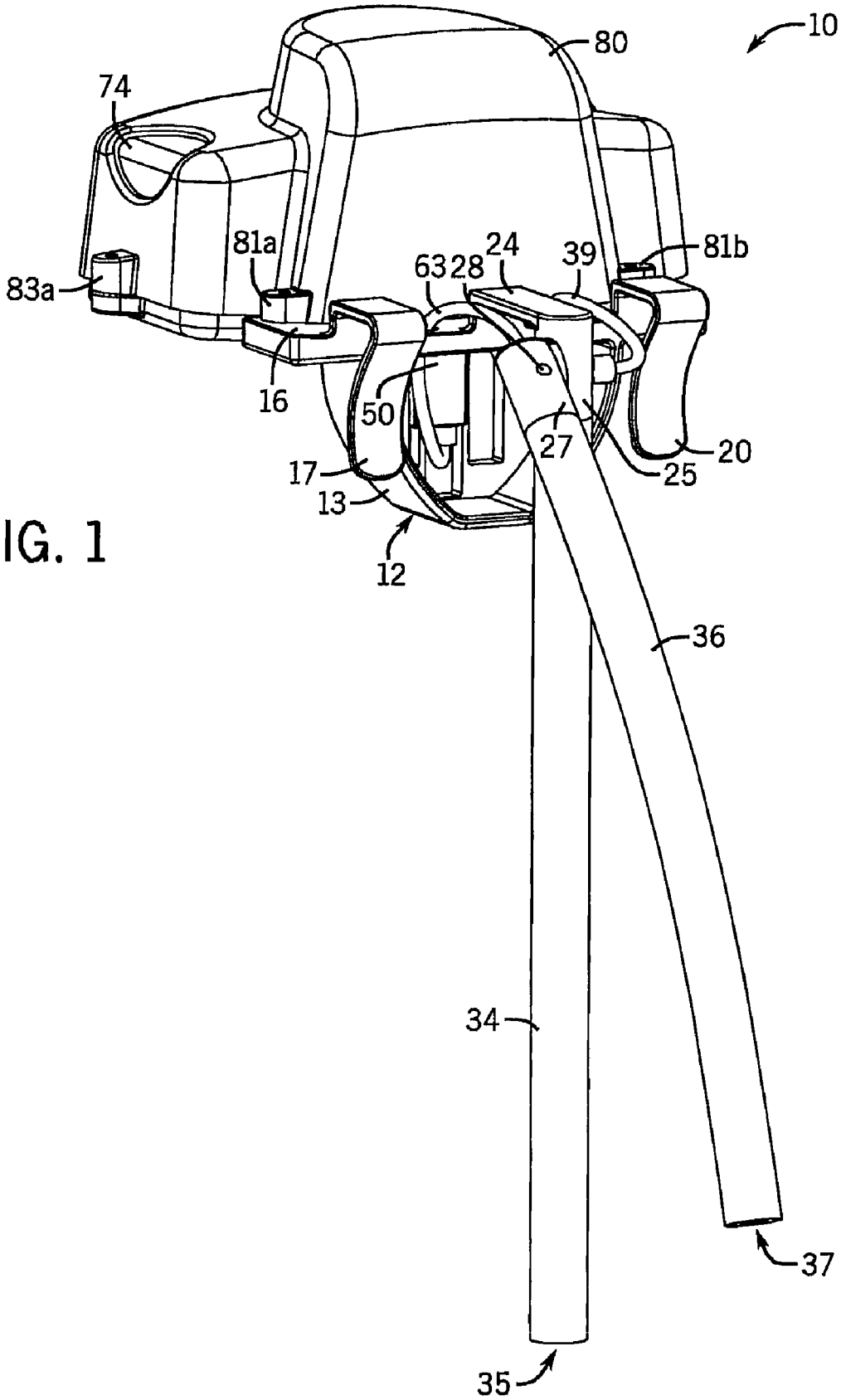
FIG. 1 is a perspective view of a dispenser of the present invention.

An example embodiment of the present invention is a dispenser that delivers liquid toilet cleaning composition to a toilet tank overflow tube during the flushing cycle in the toilet tank. However, it should be appreciated from the present description that the invention will be suitable for use with any liquid holding tank in which the liquid level changes, and any composition as long as the composition can flow.

Turning now to FIGS. 1 to 5, there is shown a dispenser 10 according to an example embodiment of the invention. All of the components of the dispenser 10 may be fabricated from corrosion resistant metallic materials, or various clear or pigmented polymeric materials, such as polyethylene, polypropylene, silicone, etc. The dispenser 10 includes a holder 12 for mounting the dispenser components to a liquid holding tank. The holder 12 includes a lower generally U-shaped wall 13 that is integral with a back vertical wall 14. The holder 12 includes a top surface 16 that can be flat or bowed slightly downward. The holder 12 includes a first mounting hook 17 having a top horizontal member 18 and a vertical member 19 that depends downwardly from the horizontal member 18. The holder 12 also includes a second mounting hook 20 having a top horizontal member 21 and a vertical member 22 that depends downwardly from the horizontal member 21. The hooks 17, 20 are used to attach the holder 12 to a tank as described below.

The holder 12 also includes a central mounting beam 24 that supports a tubular first socket 25 having a hollow side port 26 that opens into an interior space of the first socket 25. The central mounting beam 24 also supports a tubular second socket 27 having an air gap hole 28 that extends into the interior of the second socket 27. The top surface 16 of the holder 12 also includes shroud mounting holes 29*a*, 29*b* at opposite sides of the top surface 16. The top surface 16 of the holder 12 further includes a supply conduit passage 30, fluid conduit passages 31*a*, 31*b* and a fluid compartment passage 32.

The dispenser 10 further includes a rigid hollow elongated fluid control tube 34 having a lower open end 35, and also includes a flexible hollow discharge conduit 36 having a lower open end 37. The fluid control tube 34 is attached to the first socket 25 (using, for example, an interference fit or an adhesive), and the discharge conduit 36 is attached to the second socket 27 (using, for example, an interference fit or an adhesive).

The dispenser 10 further includes a fluid conduit 39 that connects the port 26 to a container closure 41. In particular, the fluid conduit 39 is placed in fluid communication with a fluid passageway 42 in the top of the closure 41. The fluid conduit 39 extends from the port 26 downward through the fluid conduit passage 31*b*, back upward through the fluid conduit passage 31*a* and into the fluid passageway 42 in the top of the closure 41 (see FIGS. 2 and 3). The fluid passageway 42 extends through the bottom surface of the closure 41. A composition passageway 46 also extends through the closure 41 to a bottom surface of the closure 41. A first composition supply conduit 48 with a lower orifice 49 places the composition passageway 46 and a fluid compartment 50 in fluid communication.

The fluid compartment 50 is installed through the fluid compartment passage 32 in the top surface 16 of the holder 12 and is held against the back vertical wall 14 of the holder 12. Looking at FIGS. 2 and 5, the generally rectangular compartment 50 includes opposed side walls 51, 52, a back wall 53, a front wall 54, and an open upper end 55. In the interior space of the compartment 50, a shoulder 56 is arranged adjacent side wall 52 (see FIG. 5). The shoulder 56 has a top surface 57. A composition exit passageway 58 extends from an upper inlet 59 in the top surface 57 to a lower outlet 60. In the interior space of the compartment 50, a lower well 61 is also formed. The compartment 50 is dimensioned to assure that no composition overflow occurs during priming. The initial surge may occur faster than composition can drain from the compartment 50. The volume of the compartment 50 just needs to be able to absorb the surge so the height of the compartment 50 required depends on the priming volume.

A second composition supply conduit 63 places the lower outlet 60 and the second socket 27 in fluid communication. The second composition supply conduit 63 extends upward from the lower outlet 60 upward through the supply conduit passage 30 in the top surface 16 of the holder 12 and back downward to the second socket 27. See FIGS. 1, 3 and 5. The downward slope of the second composition supply conduit 63 to the second socket 27 creates an inverted U-shape at the top of the second composition supply conduit 63 (see FIG. 1).

Figure 3:
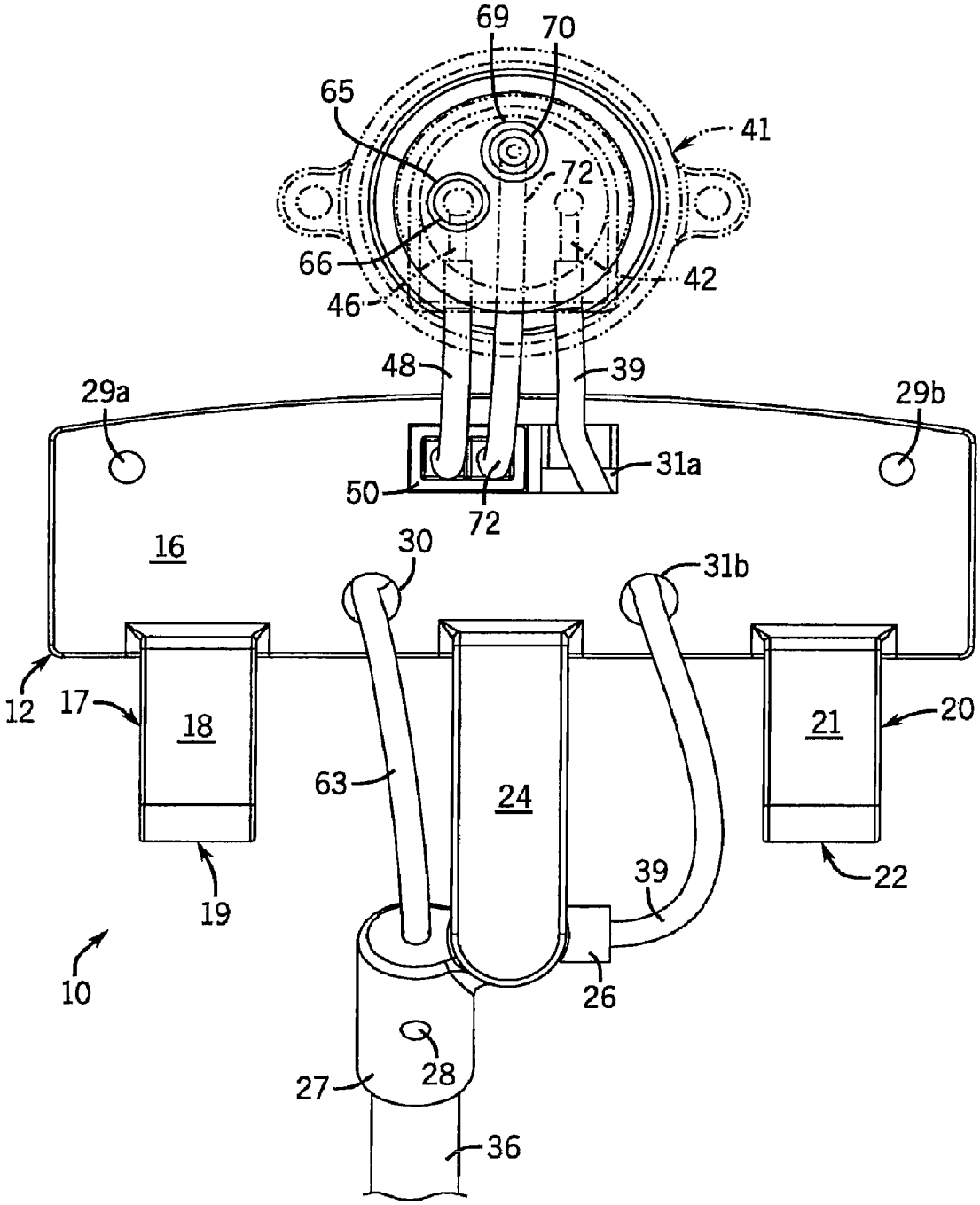
FIG. 3 is a cross-sectional view taken along line 3-3 of FIG. 2 with the top shroud and the container omitted.
Figure 4:
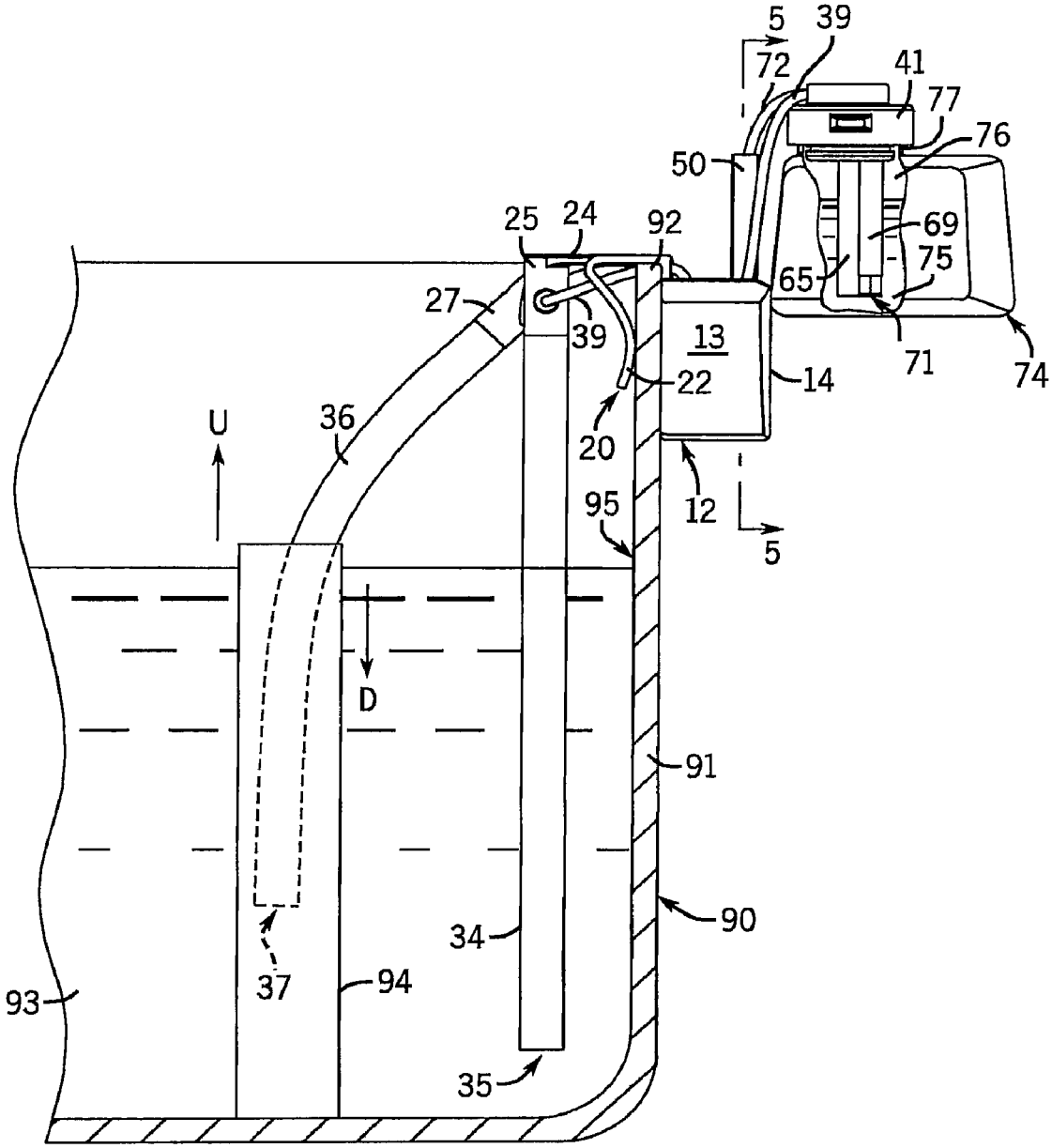
FIG. 4 is a side view of the dispenser of FIG. 1 installed on a toilet tank.
Figure 5:
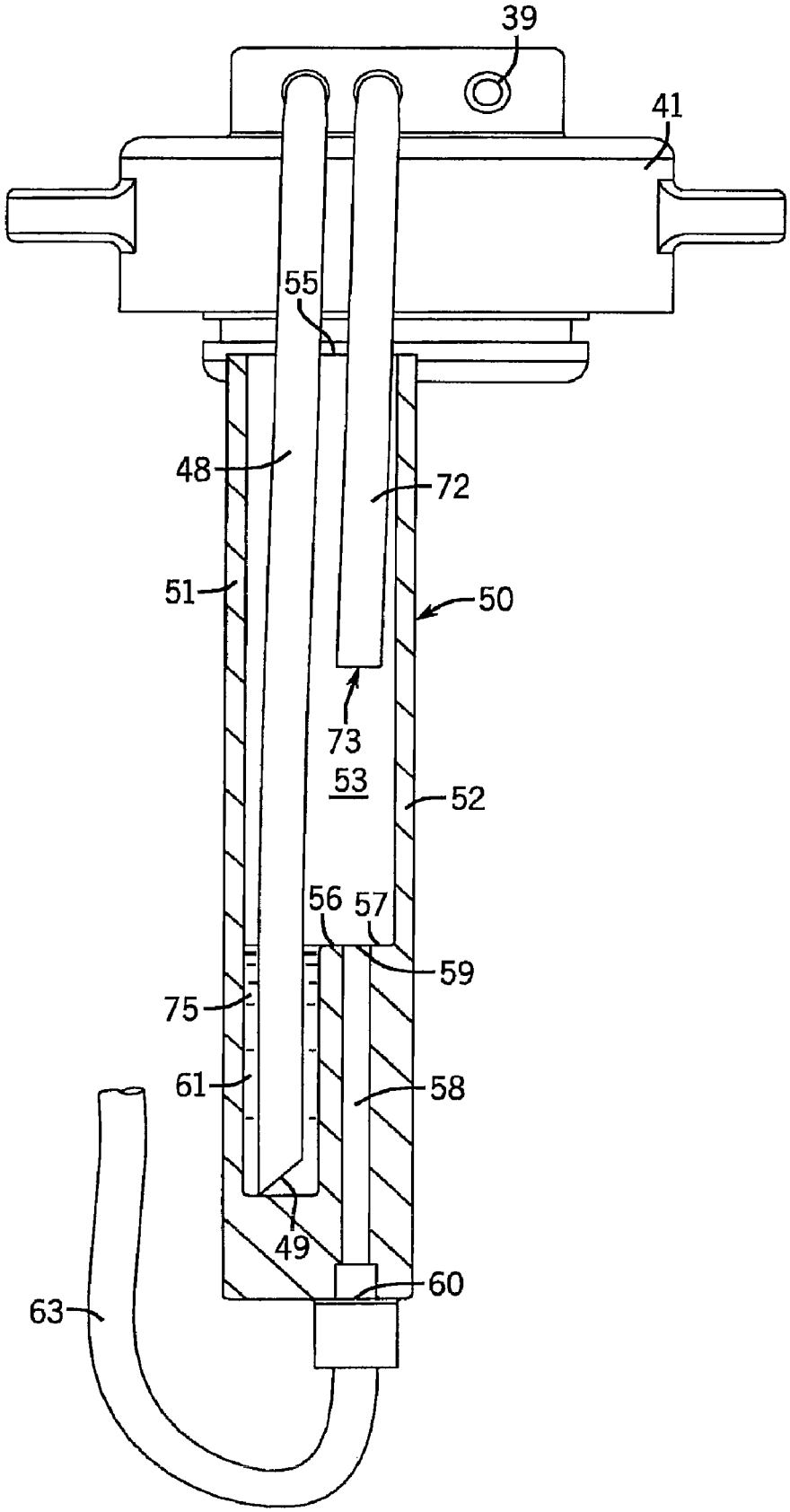
FIG. 5 is a cross-sectional view of the dispenser taken along line 5-5 of FIG. 4 with the container, the supply tube, the vent tube, and the holder omitted.

Referring now to FIGS. 3 and 4, the dispenser 10 includes a tubular supply tube 65 having an upper end opening 66 and a lower end opening 67. The upper end opening 66 of the supply tube 65 is connected to the composition passageway 46 to place the upper end opening 66 of the supply tube 65 in fluid communication with the composition passageway 46. The dispenser 10 further includes a tubular vent tube 69 having an upper end opening 70 and a lower end opening 71. The upper end opening 70 of the vent tube 69 is connected to a vent conduit 72 having a lower end opening 73 that is positioned in the interior space of the compartment 50 as shown in FIG. 5. Air can flow from the interior space of the compartment 50 through the vent conduit 72, through the vent tube 69 and out of the lower end opening 71 of the vent tube 69.

Figure 2:
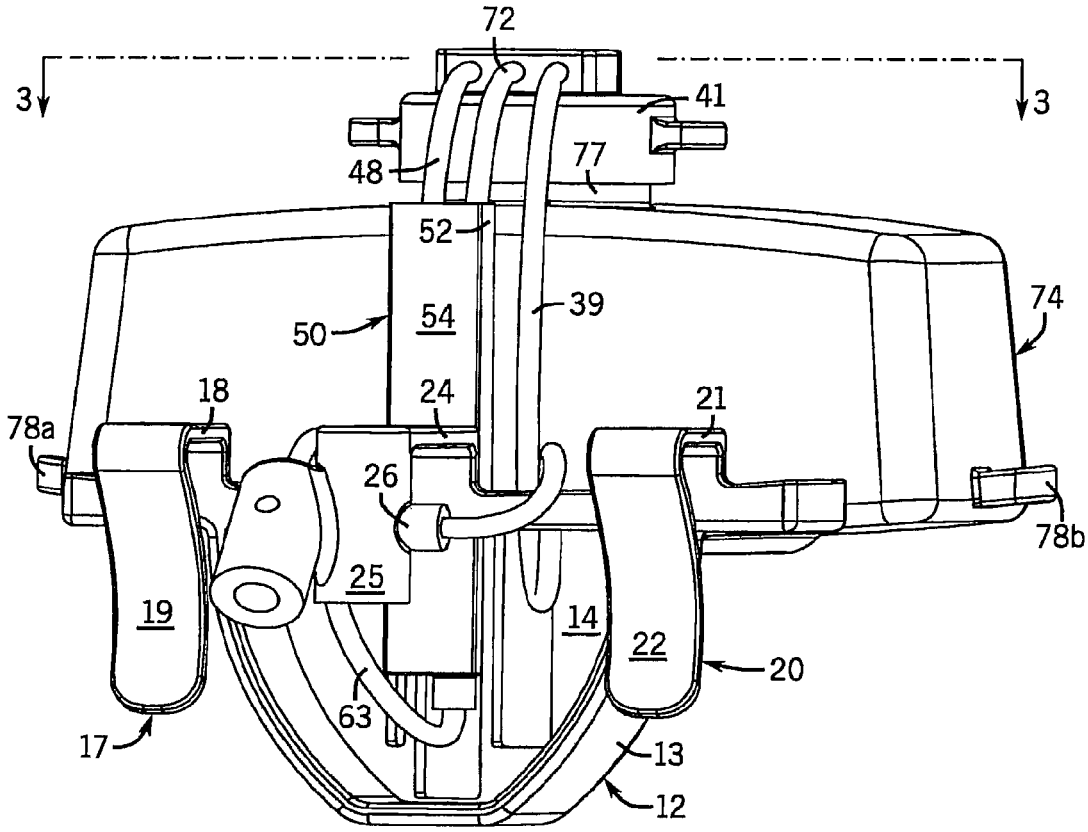
FIG. 2 is another perspective view of the dispenser of FIG. 1 with the top shroud, the fluid control tube, and the discharge conduit omitted.

The dispenser 10 also includes a container 74. The container 74 holds a flowable composition 75, preferably a liquid cleaner. Headspace 76 is created in the container 74 above the composition 75. The container 74 has an open mouth 77 that can be installed for leak-free fit in the closure 41 by way of suitable means such as an interference fit, a bayonet mounting, a pin and track mounting, a snap and socket mounting, or a hose-type coupler. The closure 41 may include a suitable sealing ring for creating a leak-free fit with the mouth 77 of the container 74. In FIG. 2, it can be seen that the container 74 includes shroud mounting tabs 78*a*, 78*b*. Looking at FIG. 4, the lower end opening 67 of the supply tube 65 opens at a location in the lower section of the interior space of the container 74, and the lower end opening 71 of the vent tube 69 also opens at a location in the lower section of the interior space of the container 74. As shown in FIG. 4, the lower end opening 67 of the supply tube 65 is located above the lower end opening 71 of the vent tube 69 in the container 74.

Referring now to FIG. 1, the dispenser 10 also includes a top shroud 80 to cover the container 74 and attach the container 74 to the holder 12. The shroud 80 has a pair of holder mounting tabs 81*a*, 81*b* that may be fastened to the holder 12 by way of suitable fasteners (e.g., screws, pins, rivets, etc.) that connect the holder mounting tabs 81*a*, 81*b* to the shroud mounting holes 29*a*, 29*b* (see FIG. 3) at opposite sides of the top surface 16 of the holder 12. The shroud 80 also has a pair of container mounting tabs 83*a* (right side tab not shown in FIG. 1) that may be fastened to the container 74 by way of suitable fasteners (e.g., screws, pins, rivets, etc.) that connect the shroud mounting tabs 78*a*, 78*b* of the container 74 to the container mounting tabs 83*a* (right side tab not shown) at opposite sides of the container 74 (see FIGS. 1 and 2).

Turning now to FIG. 4, the dispenser 10 is shown mounted on a toilet tank 90. The toilet tank 90 has an outer wall 91 having a top end 92. Water 93 is contained in the toilet tank 90, and the toilet tank 90 includes an overflow tube 94. The functioning of a toilet overflow tube is known in the art and therefore, will not be described further. When the dispenser 10 is mounted on the toilet tank 90, the top horizontal member 18 of the first mounting hook 17 rests on the top end 92 of the outer wall 91 of the toilet tank 90, and the vertical member 19 of the first mounting hook 17 resiliently engages an inner surface 95 of the outer wall 91 of the toilet tank 90. The top horizontal member 21 of the second mounting hook 20 also rests on the top end 92 of the outer wall 91 of the toilet tank 90, and the vertical member 22 of the second mounting hook 20 resiliently engages the inner surface 95 of the outer wall 91 of the toilet tank 90. The central mounting beam 24 also rests on the top end 92 of the outer wall 91 of the toilet tank 90. When the dispenser 10 is mounted on the toilet tank 90, the lower open end 35 of the hollow fluid control tube 34 is located in a lower position in the toilet tank 90, and the lower open end 37 of the flexible hollow discharge conduit 36 is located in the overflow tube 94. When the tank lid is placed back on the toilet tank 90, the user does not see the fluid control tube 34 and the hollow discharge conduit 36.

Having described the components of the dispenser 10 and the mounting of the dispenser 10 on a toilet tank 90, fluid flow in the dispenser 10 can be explained further. Starting first with the fluid control tube 34, when the fluid control tube 34 is placed in the water 93 contained in the toilet tank 90, the water 93 rises to a level within the fluid control tube 34 approximately equal to the level of water 93 in the toilet tank 90.

When the toilet is flushed, the level of water 93 in the fluid control tube 34 and the level of water 93 in the toilet tank 90 move downward in direction D in FIG. 4. The downward movement of the water 93 in the fluid control tube 34 creates downward suction in the fluid control tube 34. Because the fluid control tube 34 is in fluid communication with the headspace 76 of the container 74 by way of the first socket 25, the side port 26, the fluid conduit 39 and the fluid passageway 42 in the top of the closure 41, a region of lower pressure is created in the headspace 76 of the container 74. The region of lower pressure in the headspace 76 of the container 74 draws atmospheric air in through the vent conduit 72, down through the vent tube 69, up through the composition 75 in the container 74 (e.g., by bubbling) and into the headspace 76 of the container 74 to restore the pressure in the headspace 76. Thus, the vent conduit 72 serves as an air inlet that allows atmospheric air to be sucked into the container 74 as the height of the tank water falls during a flush to maintain atmospheric pressure in the container 74.

When the toilet flapper valve closes during the flushing cycle in the typical manner, the level of water 93 in the fluid control tube 34 and the level of water 93 in the toilet tank 90 move back upward in direction U in FIG. 4. The upward movement of the water 93 in the fluid control tube 34 displaces air upward in the fluid control tube 34. Because the fluid control tube 34 is in fluid communication with the headspace 76 of the container 74 by way of the first socket 25, the side port 26, the fluid conduit 39 and the fluid passageway 42 in the top of the closure 41, a region of higher pressure is created in the headspace 76 of the container 74. The region of higher pressure in the headspace 76 of the container 74 pushes composition 75 up through the supply tube 65, into composition passageway 46, down into the first composition supply conduit 48 and into the well 61 of the fluid compartment 50 to restore the pressure in the headspace 76. Thus, the rise and fall of the water 93 in the tank 90 translates into a consistent dosage volume of composition 75. Typically, the height difference in the rise and fall of the water 93 during a flush multiplied by the interior cross sectional area of the fluid control tube 34 equals the volume of composition 75 delivered per dose as the volume of air forces an equal volume of composition 75 from the container 74. While the inner surface of the fluid control tube 34 in the example embodiment is circular (creating an interior cross sectional area of radius squared multiplied by pi), it should be appreciated that the fluid control tube can have different shapes and/or different interior dimensions that create different interior cross sectional areas.

The composition 75 collects in the well 61 of the fluid compartment 50. The well 61 remains filled with the composition 75 applying back pressure to keep the first composition supply conduit 48 primed. When more composition 75 is added to the well 61 of the fluid compartment 50, the composition 75 rises above the top surface 57 of the shoulder 56 of the compartment 50. The composition 75 then enters the composition exit passageway 58 and exits the lower outlet 60. The composition 75 then enters the second composition supply conduit 63 and continues to the second socket 27 and the discharge conduit 36 where the composition 75 is discharged into the overflow tube 94. The air gap hole 28 in the second socket 27 allows air into the second socket 27 to stop the siphon, preventing the entire volume of composition 75 from dosing in one shot. Because the composition 75 is discharged into the overflow tube 94, the composition 75 enters directly into the toilet bowl without entering the water 93 in the tank 90. As a result, the composition 75 does not get diluted with the water 93 in the tank 90 and does not merely get flushed down the drain. The composition 75 is allowed to work within the toilet bowl (e.g., by cleaning, disinfecting, fragrancing) until the next flush.

Turning now to FIGS. 6-12, there is shown a dispenser 110 according to a second example embodiment of the invention. All of the components of the dispenser 110 may be fabricated from corrosion resistant metallic materials, or various clear or pigmented polymeric materials, such as polyethylene, polypropylene, silicone, etc. The dispenser 110 includes a holder 112 for mounting the dispenser components to a liquid holding tank. The holder 112 includes a lower generally U-shaped wall 113 that is integral with a back vertical wall 114. The holder 112 includes a clip 117 having a top front horizontal member 118 and a front vertical member 119 that depends downwardly from the top front horizontal member 118. The clip 117 also includes an intermediate vertical member 120 that depends downwardly from the top front horizontal member 118, and a top rear horizontal member 121 and a rear vertical member 122 that depends downwardly from the top rear horizontal member 121. The front vertical member 119, the top front horizontal member 118, and the intermediate vertical member 120 are used to attach the holder 112 to a tank as described below.

The holder 112 also includes a mounting bracket 123 that is attached to the front vertical member 119, and supports a level sensing assembly 124. The holder 112 also includes a mounting plate 125 that is attached to the front vertical member 119. The mounting plate 125 supports a tubular socket 127 having an air gap hole 128 that extends into the interior of the socket 127. A flexible hollow discharge conduit 130 having a lower open end 131 is attached to the socket 127 (using, for example, an interference fit or an adhesive). A port 132 is in fluid communication with the interior of the socket 127.

Figure 8:
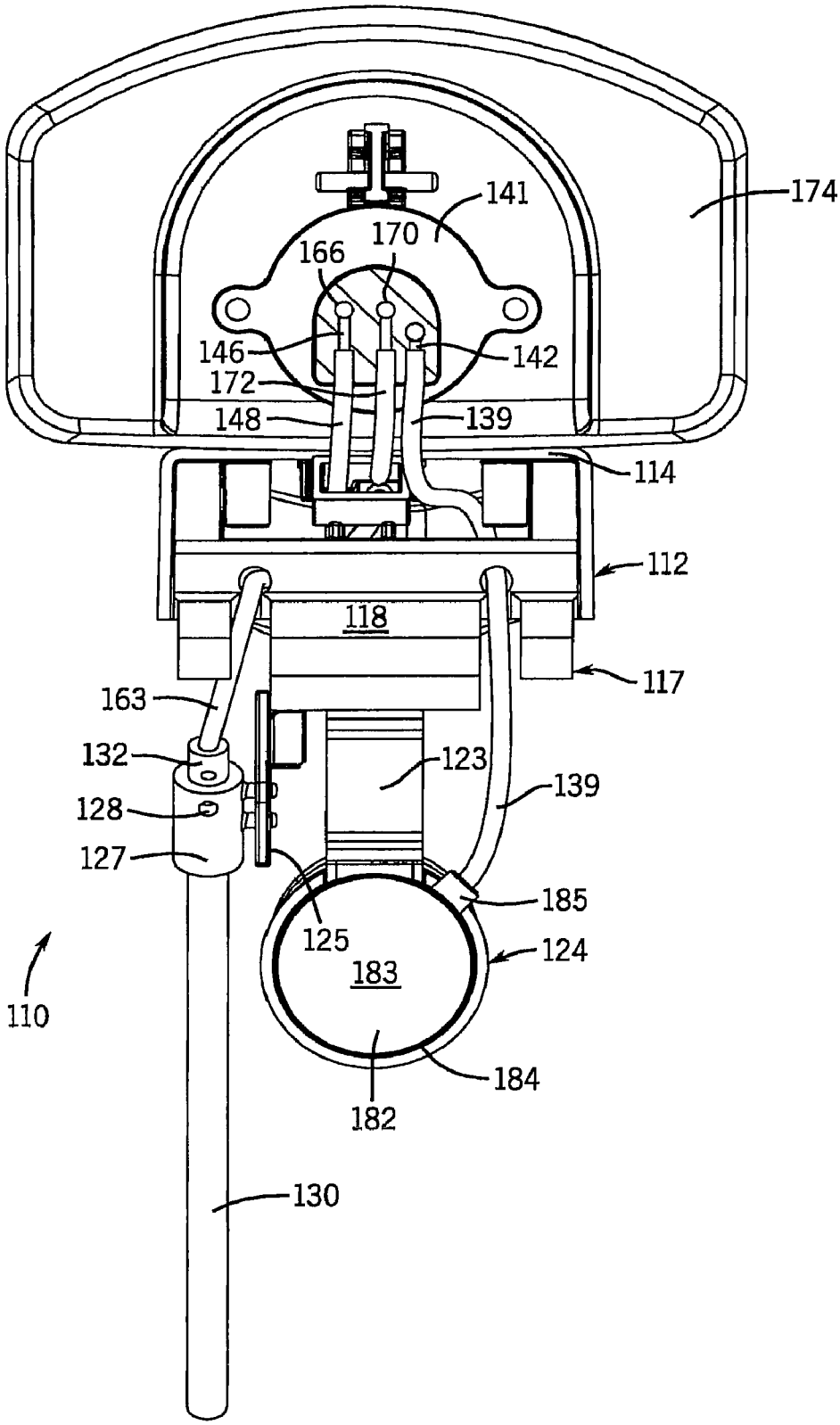
FIG. 8 is a top plan view taken along line 8-8 of FIG. 7 with the top shroud omitted.
Figure 9:
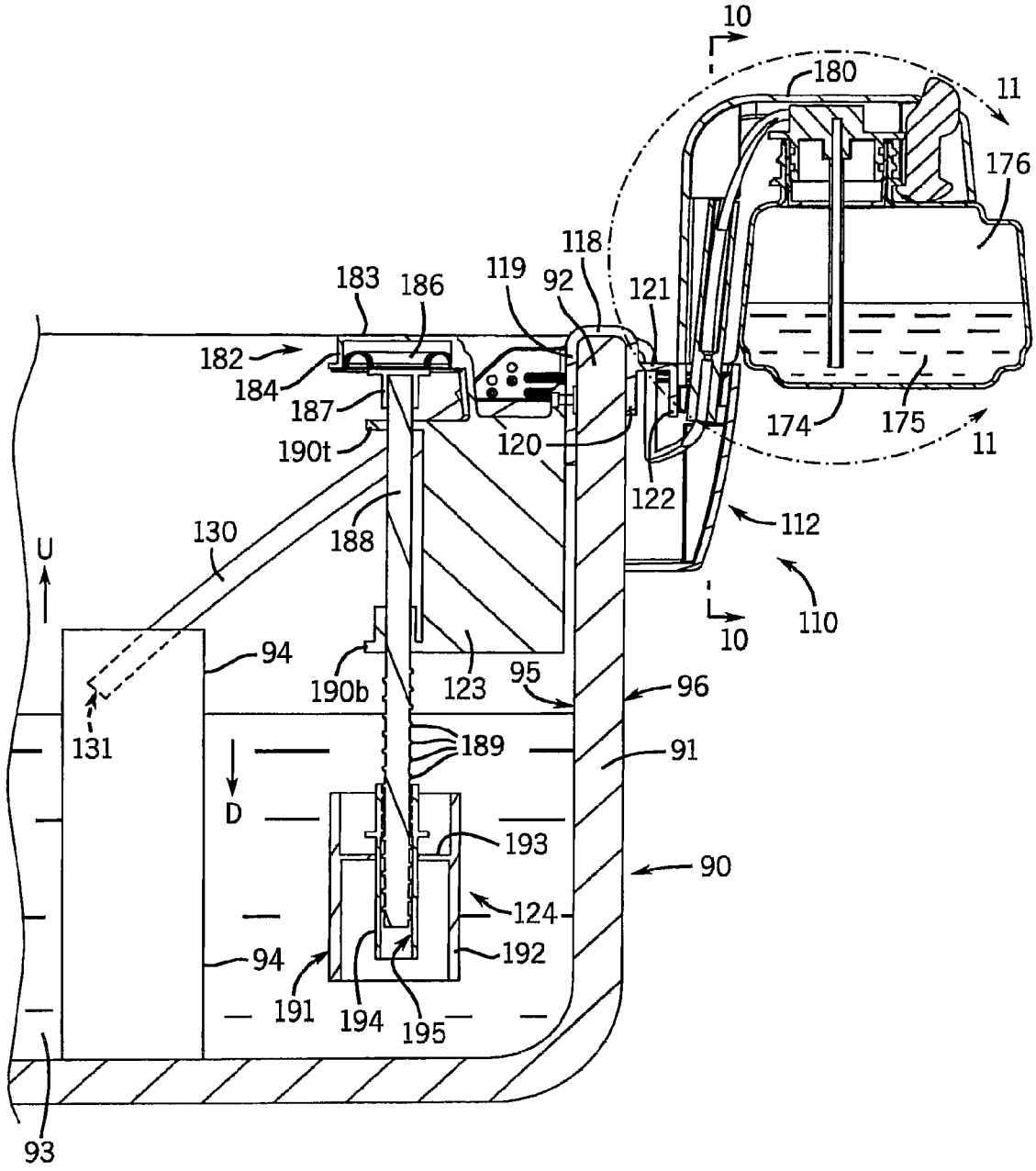
FIG. 9 is a side view of the dispenser of FIG. 6 installed on a toilet tank, the view of the dispenser being a cross-sectional view taken along line 9-9 of FIG. 7.

Looking next at FIGS. 8 and 9, the level sensing assembly 124 includes a housing 182 having a top wall 183 and a circular side wall 184 that extends downwardly from the top wall 183. The side wall 184 has a fluid port 185 with a central passageway that extends through the side wall 184. The fluid port 185 is connected to a fluid conduit 139. The level sensing assembly 124 also includes a rolling seal flexible diaphragm 186 that is coupled along its circumference to the side wall 184 of the housing 182. The diaphragm 186 can be formed from an elastomeric material such as rubber. A piston 187 is attached to the bottom surface of the diaphragm 186 for flexing the diaphragm 186. A rod 188 is connected to the piston 187. The rod 188 includes threads 189 at its lower end. The rod 188 is supported in a vertical orientation by spaced apart collars 190*b*, 190*t* of the mounting bracket 123. The level sensing assembly 124 also includes a float 191 having a cylindrical outer wall 192 that is attached by an annular plate 193 to a cylindrical inner wall 194. The cylindrical inner wall 194 has an inner surface 195 with threads. The internal threads on the inner surface 195 of the cylindrical inner wall 194 of the float 191 engage the external threads 189 on the rod 188. The position of the float 191 on the rod 188 can be adjusted by screwing and unscrewing of the float 191 on the rod 188.

The dispenser 110 includes a fluid compartment 150 that is installed to the holder 112 and is held against the back vertical wall 114 of the holder 112. Looking at FIGS. 7 and 10, the generally rectangular compartment 150 includes opposed side walls 151, 152, a back wall 153, a front wall 154, and an open upper end 155. In the interior space of the compartment 150, a shoulder 156 is arranged adjacent side wall 152 (see FIG. 10). The shoulder 156 has a top surface 157. A composition exit passageway 158 extends from an upper inlet 159 in the top surface 157 to a lower outlet 160. In the interior space of the compartment 150, a lower well 161 is also formed. The compartment 150 is dimensioned to assure that no composition overflow occurs during priming. The initial surge may occur faster than composition can drain from the compartment 150. The volume of the compartment 150 just needs to be able to absorb the surge so the height of the compartment 150 required depends on the priming volume. A second composition supply conduit 163 places the lower outlet 160 of the compartment 150 and the socket 127 in fluid communication. The downward slope of the second composition supply conduit 163 to the socket 127 creates an inverted U-shape at the top of the second composition supply conduit 163 (see FIG. 7).

Figure 7:
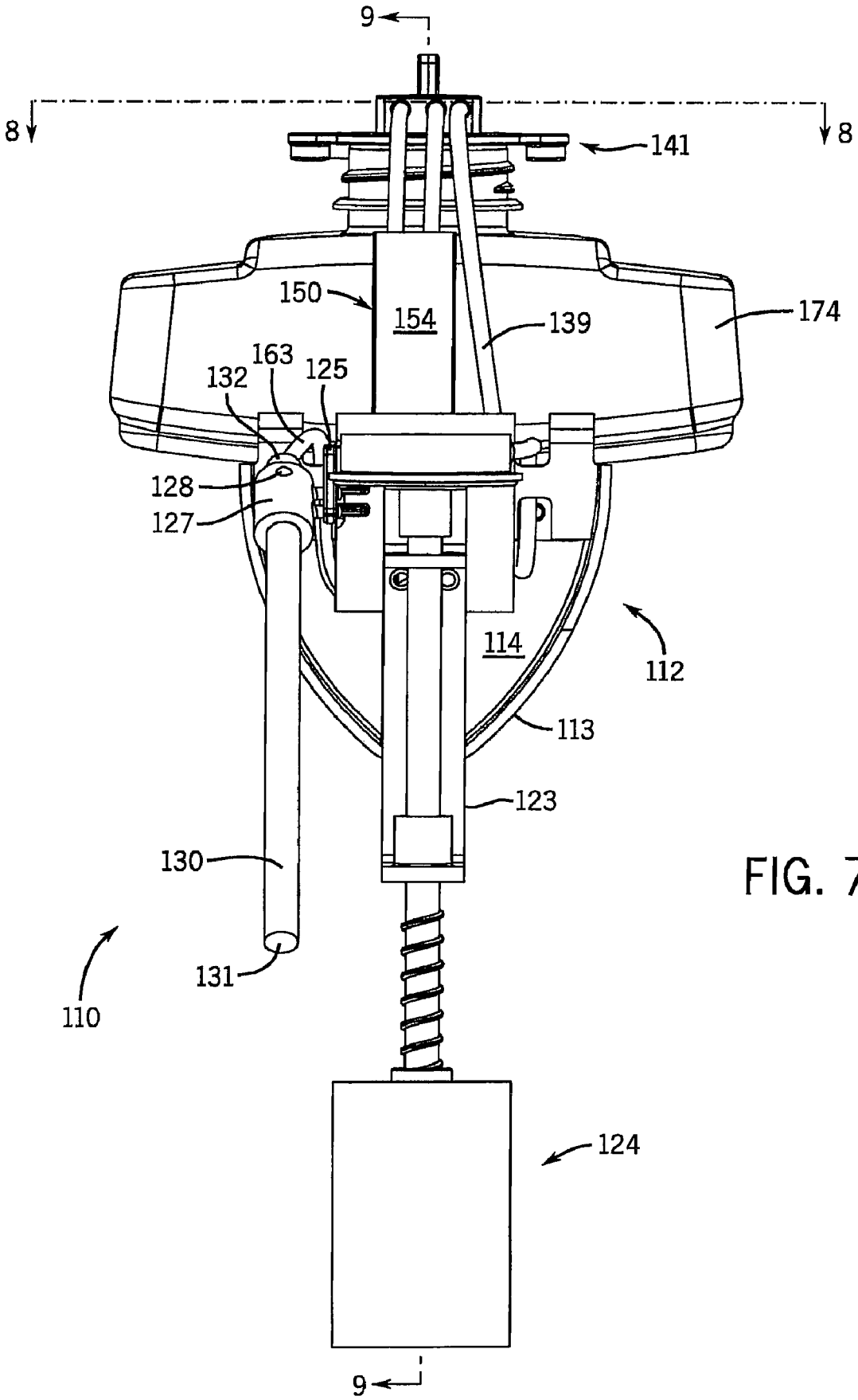
FIG. 7 is a front elevational view of the dispenser of FIG. 6 with the top shroud omitted.
Figure 10:
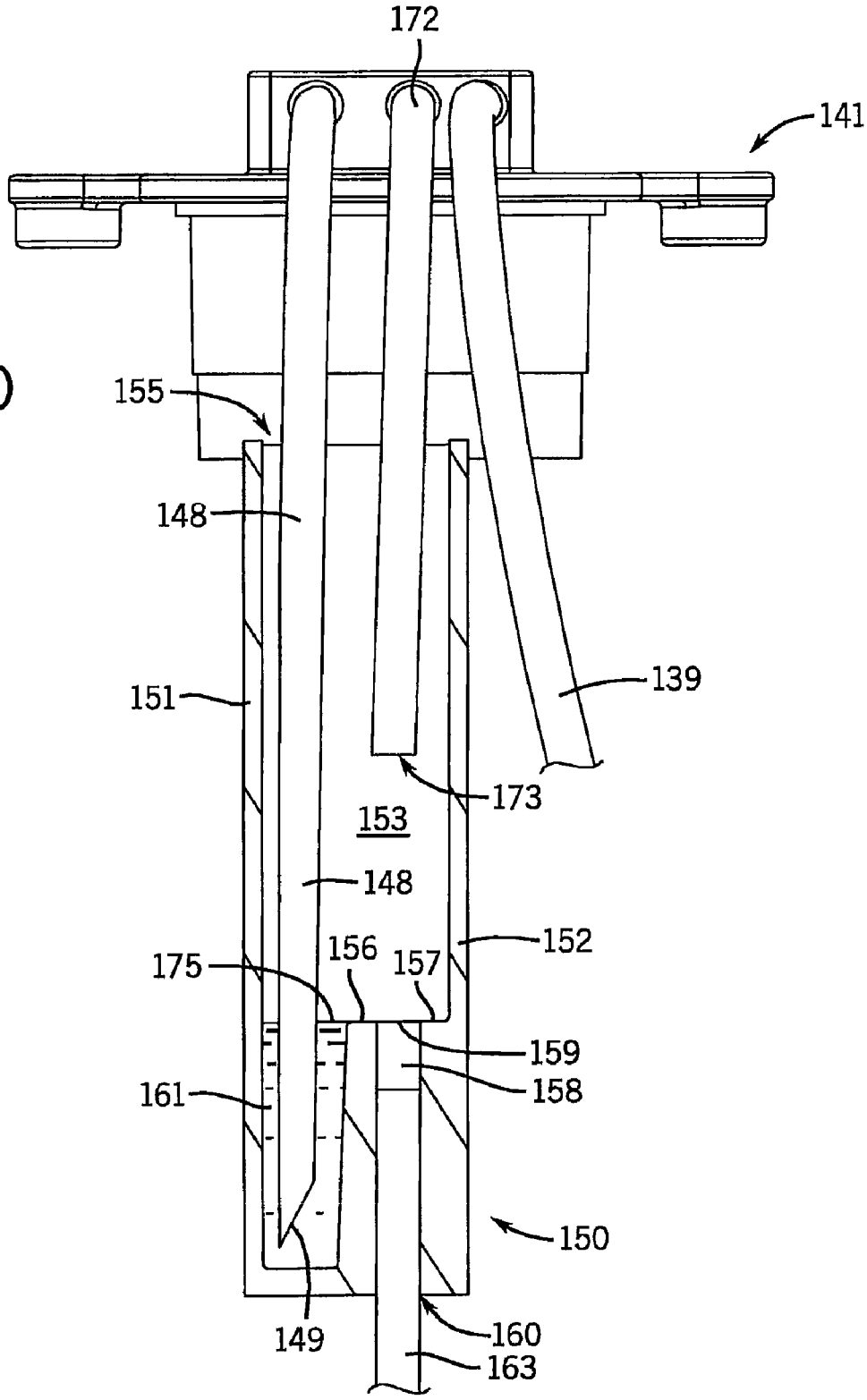
FIG. 10 is a cross-sectional view of the dispenser of FIG. 6 taken along line 10-10 of FIG. 9 with the container and the holder omitted.

Looking at FIGS. 7 and 8, the dispenser 110 further includes a container closure 141. The fluid conduit 139 is placed in fluid communication with a fluid passageway 142 in the top of the closure 141. The fluid passageway 142 extends through the bottom surface of the closure 141. A composition passageway 146 also extends through the closure 141 to a bottom surface of the closure 141. A first composition supply conduit 148 with a lower orifice 149 places the composition passageway 146 and the fluid compartment 150 in fluid communication as shown in FIGS. 8 and 10.

Figure 12:
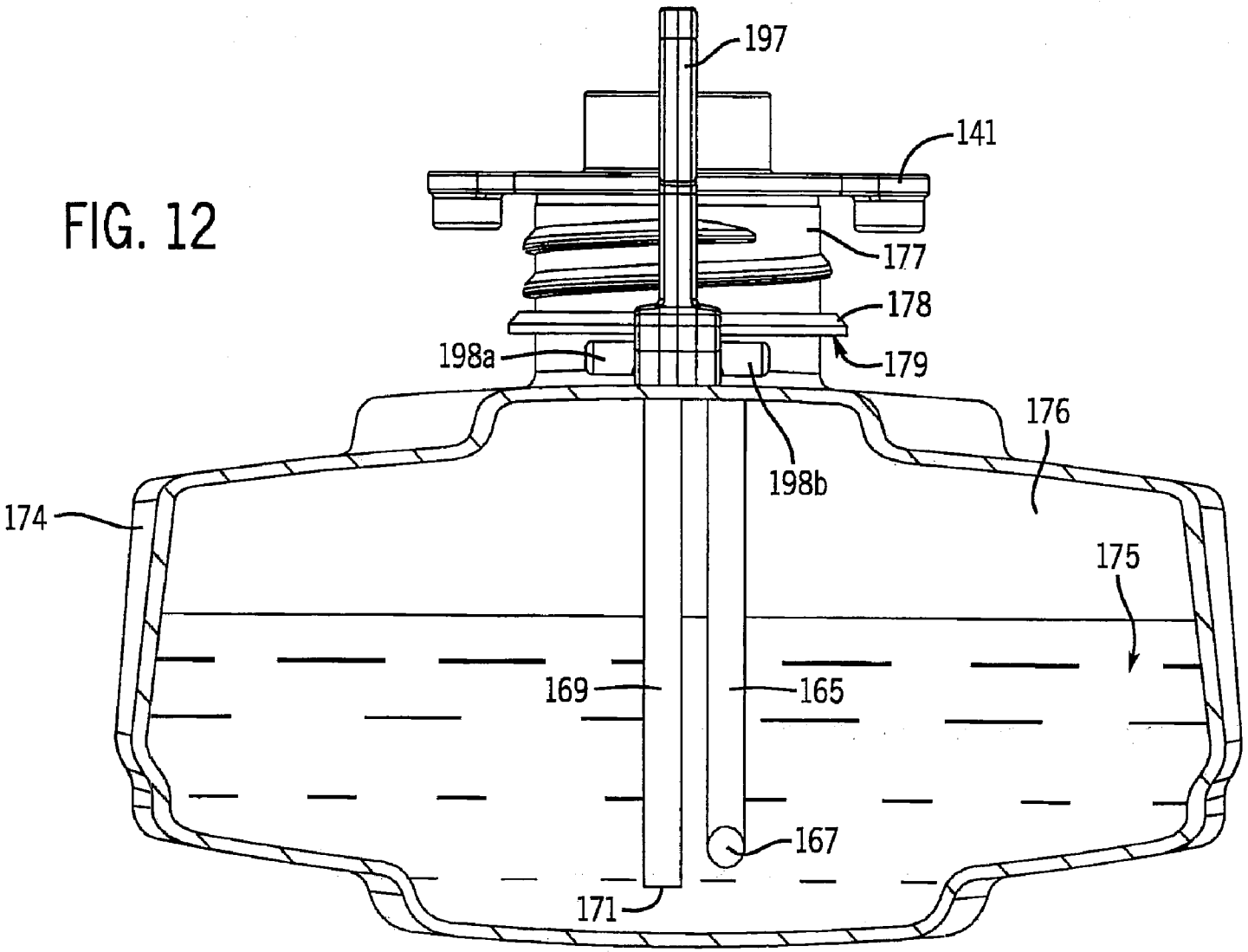
FIG. 12 is a cross-sectional view of the dispenser of FIG. 6 taken along line 12-12 of FIG. 11 with the shroud omitted.

Referring to FIGS. 8 and 12, the dispenser 110 includes a tubular supply tube 165 having an upper end opening 166 and a lower end opening 167. The upper end opening 166 of the supply tube 165 is connected to the composition passageway 146 to place the upper end opening 166 of the supply tube 165 in fluid communication with the composition passageway 146. The dispenser 110 further includes a tubular vent tube 169 having an upper end opening 170 connected to a vent conduit 172 and having a lower end opening 173 that is positioned in the interior space of the compartment 150 as shown in FIG. 10. Air can flow from the interior space of the compartment 150 through the vent tube 169, through the vent conduit 172, and out of the lower end opening 173 of the vent conduit 172.

Figure 6:
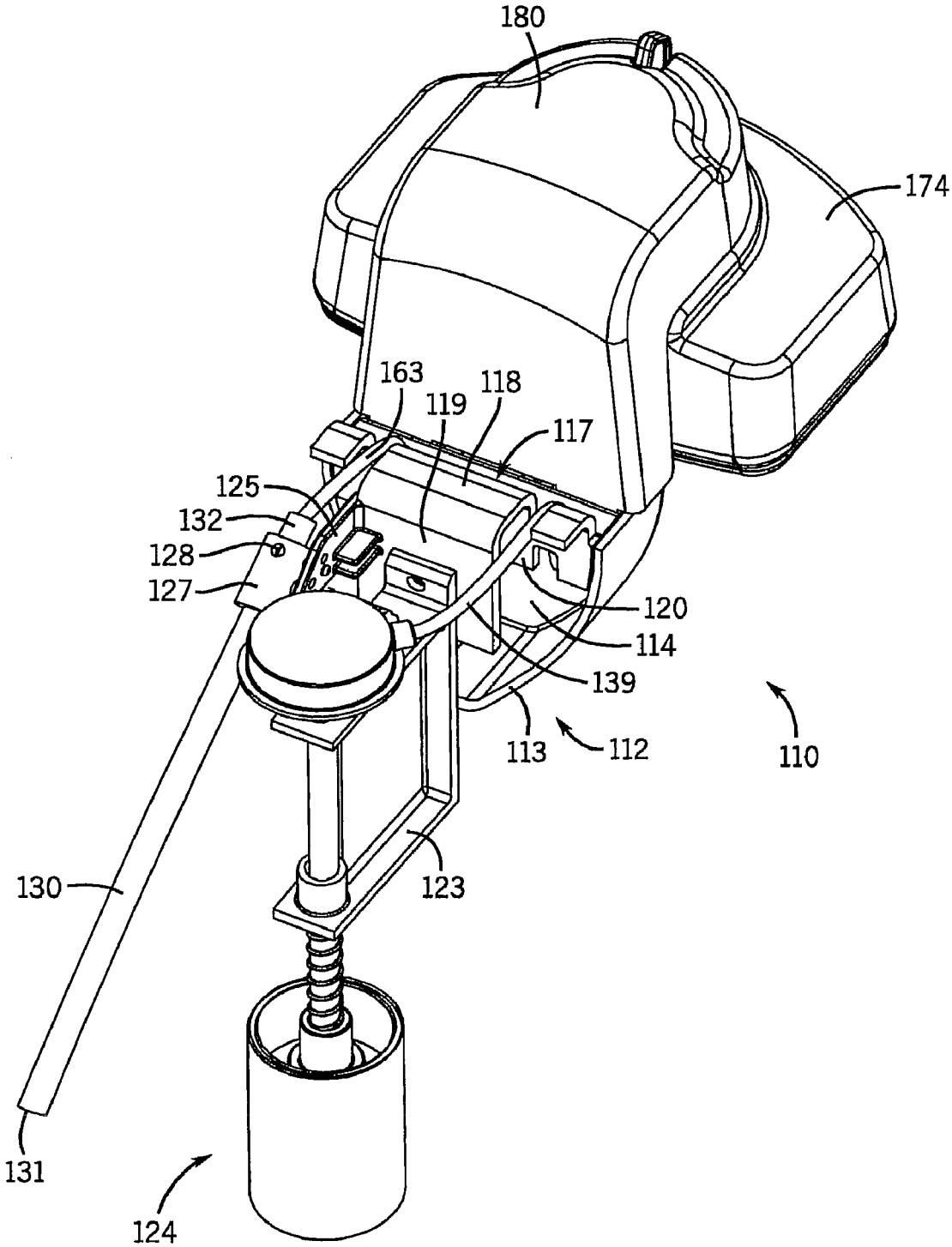
FIG. 6 is a top, front, right perspective view of a second embodiment of a dispenser of the present invention.

The dispenser 110 also includes a container 174. The container 174 holds a flowable composition 175, preferably a liquid cleaner. Headspace 176 is created in the container 174 above the composition 175. The container 174 has an open mouth 177 that can be installed for leak-free fit in the closure 141 by way of suitable means such as an interference fit, a bayonet mounting, a pin and track mounting, a snap and socket mounting, or a hose-type coupler. The closure 141 may include a suitable sealing insert 144 (see FIG. 11) for creating a leak-free fit with the mouth 177 of the container 174. Referring now to FIG. 6, the dispenser 110 also includes a top shroud 180 to cover the container 174. The shroud 180 is attached to the holder 112.

Figure 11:
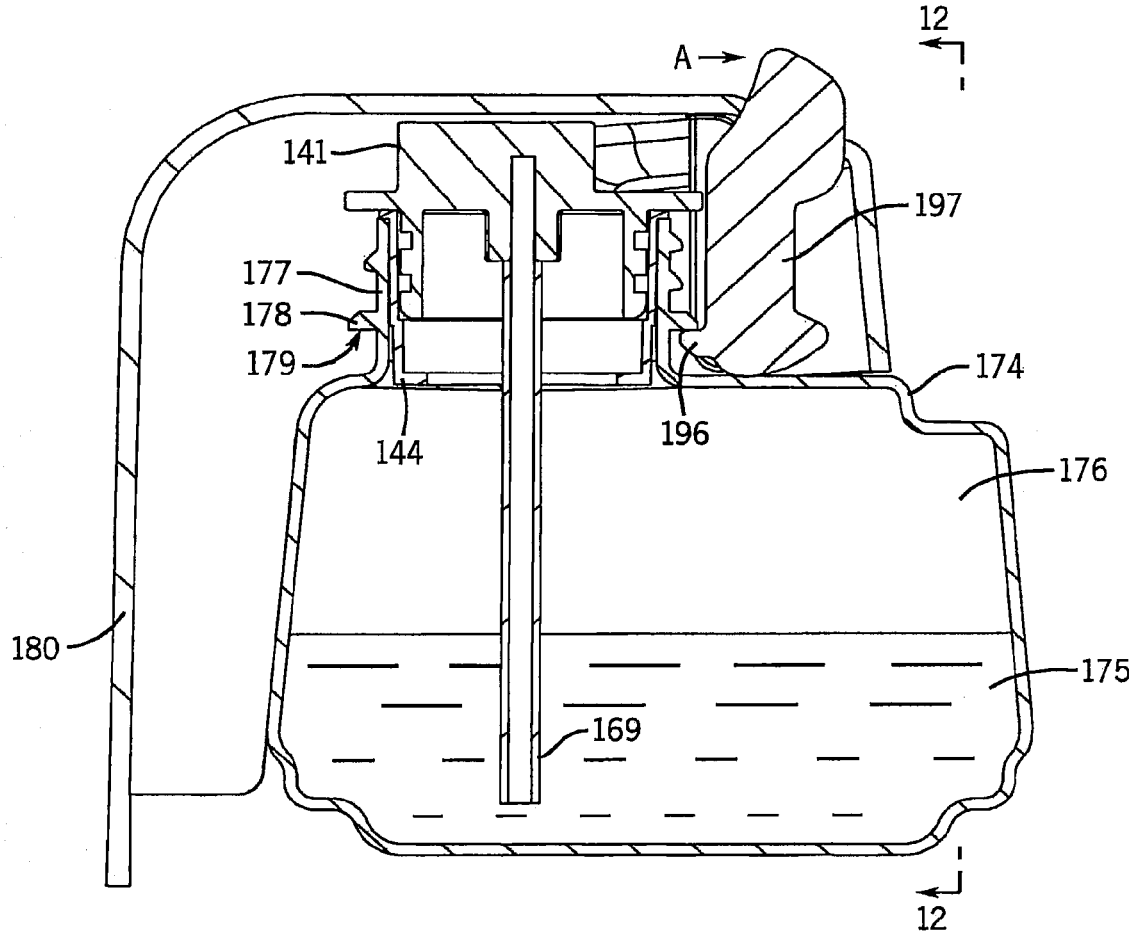
FIG. 11 is a detailed view of the dispenser of FIG. 6 taken along line 11-11 of FIG. 9.

Referring to FIGS. 11 and 12, the mouth 177 of the container 174 includes a circular flange 178 having a lower surface 179. When the container 174 in installed against the closure 141, the lower surface 179 of the flange 178 is engaged by a protrusion 196 on a latch 197 that is pivotally mounted to the shroud 180 by way of pins 198*a*, 198*b*. The protrusion 196 on the latch 197 may be biased toward the mouth 177 of the container 174 by a spring. The container 174 may be removed from the closure 141 by pressing the latch 197 in direction "A" in FIG. 11 and pulling the container 174 downward away from the closure 141. As shown in FIG. 12, the lower end opening 167 of the supply tube 165 opens at a location in the lower section of the interior space of the container 174, and the lower end opening 171 of the vent tube 169 also opens at a location in the lower section of the interior space of the container 174.

Thus, the latch 197 allows consumers to secure the removable container 174 in place, and can also be used to help remove the container 174 when the container 174 is empty. Simply pushing the container 174 onto the closure 141 causes the latch 197 to click into place. This mechanical attachment adds a level of security to the friction fit between the mouth 177 of the container 174 and the sealing insert 144 of the closure 141. The latch 197 can be used to help dislodge the mouth 177 of the container 174 from the sealing insert 144 of the closure 141.

Turning now to FIG. 9, the dispenser 110 is shown mounted on a toilet tank 90. The toilet tank 90 has an outer wall 91 having a top end 92. Water 93 is contained in the toilet tank 90, and the toilet tank 90 includes an overflow tube 94. The functioning of a toilet overflow tube is known in the art and therefore, will not be described further. When the dispenser 110 is mounted on the toilet tank 90, the top front horizontal member 118 rests on the top end 92 of the outer wall 91 of the toilet tank 90, the front vertical member 119 resiliently engages an inner surface 95 of the outer wall 91 of the toilet tank 90, and the intermediate vertical member 120 resiliently engages an outer surface 96 of the outer wall 91 of the toilet tank 90. When the dispenser 110 is mounted on the toilet tank 90, the lower open end 131 of the flexible hollow discharge conduit 130 is located in the overflow tube 94. The user can set the bottom of the float 191 to the height of the water 93 just as the tank 90 starts to fill (i.e., in the middle of a flush).

Having described the components of the dispenser 110 and the mounting of the dispenser 110 on a toilet tank 90, fluid flow in the dispenser 110 can be explained further. When the toilet is flushed, the level of water 93 in the toilet tank 90 moves downward in direction D in FIG. 9. As the level of water 93 falls, downward movement of the float 191 creates downward suction in the interior of the housing 182 above the diaphragm 186 because the diaphragm 186 flexes downward due to the piston 187 moving downward with the rod 188 and float 191. Because the housing 182 is in fluid communication with the headspace 176 of the container 174 by way of the port 185, the fluid conduit 139 and the fluid passageway 142 in the top of the closure 141, a region of lower pressure is created in the headspace 176 of the container 174. The region of lower pressure in the headspace 176 of the container 174 draws atmospheric air in through the vent conduit 172, down through the vent tube 169, up through the composition 175 in the container 174 (e.g., by bubbling) and into the headspace 176 of the container 174 to restore the pressure in the headspace 176. Thus, the vent conduit 172 serves as an air inlet that allows atmospheric air to be sucked into the container 174 as the height of the tank water falls during a flush to maintain atmospheric pressure in the container 174.

When the toilet flapper valve closes during the flushing cycle in the typical manner, the level of water 93 in the toilet tank 90 moves back upward in direction U in FIG. 9. The upward movement of the water 93 and the float 191 (which rises with the water 93) flexes the diaphragm 186 upward due to the piston 187 moving upward with the rod 188 and float 191. Because the interior of the housing 182 is in fluid communication with the headspace 176 of the container 174 by way of the port 185, the fluid conduit 139 and the fluid passageway 142 in the top of the closure 141, a region of higher pressure is created in the headspace 176 of the container 174. The region of higher pressure in the headspace 176 of the container 174 pushes composition 175 up through the supply tube 165, into composition passageway 146, down into the first composition supply conduit 148 and into the well 161 of the fluid compartment 150 to restore the pressure in the headspace 176. Thus, the rise and fall of the water 93 in the tank 90 translates into a consistent dosage volume of composition 175.

The composition 175 collects in the well 161 of the fluid compartment 150. The well 161 remains filled with the composition 175 applying back pressure to keep the first composition supply conduit 148 primed. When more composition 175 is added to the well 161 of the fluid compartment 150, the composition 175 rises above the top surface 157 of the shoulder 156 of the compartment 150. The composition 175 then enters the composition exit passageway 158 and exits the lower outlet 160. The composition 175 then enters the second composition supply conduit 163 and continues to the socket 127 and the discharge conduit 130 where the composition 175 is discharged into the overflow tube 94. The air gap hole 128 in the socket 127 allows air into the socket 127 to stop the siphon, preventing the entire volume of composition 175 from dosing in one shot. The internal diameter of the discharge conduit 130 downstream from the air gap hole 128 can be varied such that the composition 175 is delivered as discrete drops, and the cleaner does not continuously wick down the internal surface of the discharge conduit 130. A ¼ inch (6.35 mm.) internal diameter in the discharge conduit 130 is suitable.

Because the composition 175 is discharged into the overflow tube 94, the composition 175 enters directly into the toilet bowl without entering the water 93 in the tank 90. As a result, the composition 175 does not get diluted with the water 93 in the tank 90 and does not merely get flushed down the drain. The composition 175 is allowed to work within the toilet bowl (e.g., by cleaning, disinfecting, fragrancing) until the next flush.

The above description has been that of example embodiments of the present invention. It will occur to those that practice the art, however, that still other modifications may be made without departing from the spirit and scope of the invention. Hence, the scope of the invention should not be entirely judged by just the example embodiments.

INDUSTRIAL APPLICABILITY

The present invention provides a dispenser that hangs on the outer wall of a toilet tank and utilizes the rise and fall of the toilet tank water during a flush to deliver a flowable cleaning composition from a container into the toilet overflow tube which then delivers the composition into the toilet bowl.

What is claimed is:

1. A dispenser for dispensing a composition in response to level changes in a liquid in a tank, the dispenser comprising:

a container for holding the composition;

a discharge conduit in fluid communication with the container;

an air inlet in fluid communication with the container; and a level sensing member mounted to the dispenser such that a lower end of the level sensing member cotacts the liquid in the tank and senses its level;

whereby a rise of the liquid in the tank between a lower liquid level and a higher liquid level can cause the level sensing member to alter air pressure in a headspace of the container above the composition and thereby cause a controlled discharge of the composition from the discharge conduit;

whereby a fall of the liquid in the tank between the higher liquid level and the lower liquid level causes the level sensing member to alter pressure in the headspace and thereby causing air to be vented into the headspace from the air inlet; and a compartment in fluid communication with the container and in fluid communication with the discharge conduit, the compartment configured to accumulate an amount of the composition before a portion of the amount of the composition is discharged from the discharge conduit;

wherein:

the compartment is in fluid communication with the container by way of a composition supply conduit having a lower orifice, the compartment includes an exit passageway having an upper inlet and a lower outlet, and the lower orifice of the composition supply conduit is positioned in the compartment below the upper inlet of the exit passageway of the compartment.

2. The dispenser of claim 1, wherein:

the dispenser further comprises a holder structured to mount the container on a top end of an outer wall of the tank.

3. The dispenser of claim 2, wherein:

the holder has at least one hook for mounting the container on a top end of an outer wall of the tank.

4. The dispenser of claim 1, further comprising:

a vent tube having an upper end opening and a lower end opening, the upper end opening of the vent tube being in fluid communication with the air inlet, and the lower end opening of the vent tube being in fluid communication with a section of an interior space of the container.

5. The dispenser of claim 1, wherein:

the upper inlet of the exit passageway is located on a top surface of an interior shoulder of the compartment, and the lower orifice of the composition supply conduit is positioned in a well below the top surface of the interior shoulder of the compartment.

6. The dispenser of claim 1, wherein:

an air gap hole is located in a discharge passageway between the container and a discharge opening of the discharge conduit.

7. The dispenser of claim 1, further comprising:

a vent tube having an upper end opening and a lower end opening, the upper end opening of the vent tube being in fluid communication with the air inlet, and the lower end opening of the vent tube being in fluid communication with a lower section of an interior space of the container; and a supply tube having an upper end opening and a lower end opening, the upper end opening of the supply tube being in fluid communication with the discharge conduit, and the lower end opening of the supply tube being in fluid communication with the lower section of the interior space of the container.

8. The dispenser of claim 1, further comprising:

a closure for sealing a mouth of the container.

9. The dispenser of claim 8, further comprising:

a vent tube attached to the closure, the vent tube having an upper end opening and a lower end opening, the upper end opening of the vent tube being in fluid communication with the air inlet, and the lower end opening of the vent tube being in fluid communication with a lower section of an interior space of the container; and a supply tube attached to the closure, the supply tube having an upper end opening and a lower end. opening, the upper end opening of the supply tube being in fluid communication with the discharge conduit, and the lower end opening of the supply tube being in fluid communication with the lower section of the interior space of the container.

10. The dispenser of claim 8, wherein the air inlet passes through the closure.

11. The dispenser of claim 8, further comprising a latch for holding the closure against the mouth of the container.

12. The dispenser of claim 1, wherein the tank is a toilet tank and the liquid is water.

13. The dispenser of claim 1 wherein:

the dispenser further comprises a housing and a diaphragm, the housing having an open end that is sealed by the diaphragm thereby defining an interior space of the housing, the interior space being in fluid communication with the headspace of the container above the composition; and the level sensing member is a float; and the float is attached to the diaphragm;

whereby the fall of liquid in the tank from a higher liquid level to a lower liquid level, the diaphragm may flex in a first direction and displace air in the headspace to be vented into the headspace from the air inlet; and whereby the rise of liquid in the tank between the lower liquid level and the higher liquid level causes the diaphragm to flex in a second direction to alter air pressure in the headspace of the container above the composition and thereby cause the controlled discharge of the composition from the discharge conduit.

14. The dispenser of claim 1, wherein:

the level sensing member is a float;

the float is attached to a rod; and a longitudinal position of the float on the rod can be adjusted.

15. A method for delivering a composition to a toilet bowl of a toilet having a toilet tank, the method comprising:

(a) providing a dispenser having (i) a container holding the composition, (ii) a level sensor in fluid communication with headspace above the composition in the container, (iii) a discharge conduit in fluid communication with the container, and (iv) an air inlet in fluid communication with the container;

(v) a compartment in fluid communication with the container and in fluid communication with the discharge conduit, the compartment configured to accumulate an amount of the composition before a portion of the amount of the composition is discharged from the discharge conduit, wherein:

the compartment is in fluid communication with the container by way of a composition supply conduit having a lower orifice, the compartment includes an exit passageway having an upper inlet and a lower outlet, and the lower orifice of the composition supply conduit is positioned in the compartment below the upper inlet of the exit passageway of the compartment;

(b) mounting the level sensor such that a lower end of the level sensor contacts water in the toilet tank;

(c) positioning the discharge conduit such that a discharge opening of the discharge conduit can deliver the composition to the toilet bowl; and (d) flushing the toilet whereby a fall of liquid in the tank between a higher liquid level and a lower liquid level causes the level sensing member to alter air pressure in a headspace of the container above the composition and thereby causing air to be vented into the headspace from the air inlet, and a subsequent rise of the liquid in the tank between a lower liquid level and a higher liquid level causes the level sensing member to alter pressure in the headspace and thereby causes a controlled discharge of the composition from the discharge conduit.

16. The method of claim 15, wherein the discharge opening of the discharge conduit is positioned in or above an overflow tube of the toilet.

17. The method of claim 15, wherein the container is mounted on a top end of an outer wall of the toilet tank.

18. The method of claim 15, wherein the container is mounted on a top end of an outer wall of the toilet tank such that the container is located outside the toilet tank.

19. The method of claim 15, wherein the dispenser is maintained at constant pressure during the fall and rise of liquid in the tank.

20. The method of claim 16, wherein the constant pressure is atmospheric pressure.

* * * * *